US009915449B1

(12) United States Patent
Pack

(10) Patent No.: US 9,915,449 B1
(45) Date of Patent: Mar. 13, 2018

(54) REFRIGERATOR-FREEZER

(71) Applicant: Patrick Pack, Battleground, WA (US)

(72) Inventor: Patrick Pack, Battleground, WA (US)

( * ) Notice: Subject to any disclaimer, the term of this patent is extended or adjusted under 35 U.S.C. 154(b) by 291 days.

(21) Appl. No.: 14/684,391

(22) Filed: Apr. 12, 2015

(51) Int. Cl.

| | |
|---|---|
| ***E06B 3/34*** | (2006.01) |
| ***E05F 11/00*** | (2006.01) |
| ***E05F 15/02*** | (2006.01) |
| ***E05F 15/10*** | (2006.01) |
| ***E05F 11/24*** | (2006.01) |
| ***E05F 11/28*** | (2006.01) |
| ***F25B 27/00*** | (2006.01) |
| ***F25D 23/00*** | (2006.01) |
| ***F25D 23/02*** | (2006.01) |

(52) U.S. Cl.
CPC ..... *F25B 27/00* (2013.01); *F25D 23/00* (2013.01); *F25D 23/028* (2013.01)

(58) Field of Classification Search
CPC ..... F25D 11/02; F25D 23/00; F25D 23/028; F25D 23/04; F25D 25/025; F25B 27/00
USPC .... 49/41, 333, 334, 339, 340, 345; 312/401, 312/404, 408
See application file for complete search history.

(56) References Cited

U.S. PATENT DOCUMENTS 3,141,662 A * 7/1964 Wise ..... F25D 23/028 475/153
3,599,371 A * 8/1971 Barroero ..... F25D 23/021 49/30
3,729,243 A * 4/1973 Musgrave ..... A47F 3/043 312/116
4,583,376 A * 4/1986 Pritchard ..... F25D 11/02 62/382
6,247,771 B1 * 6/2001 Miller ..... A47L 15/506 312/272
7,232,196 B2 * 6/2007 Kwon ..... A47B 46/005 312/402
7,396,093 B2 * 7/2008 Jeong ..... A47B 46/00 312/310
7,628,461 B2 * 12/2009 Carden ..... F25D 25/025 312/310
8,231,190 B2 * 7/2012 Ertz ..... F25D 25/025 312/323

(Continued)

*Primary Examiner* — Allen Flanigan
*Assistant Examiner* — Filip Zec
(74) *Attorney, Agent, or Firm* — Gulf Coast Intellectual Property Group

(57) ABSTRACT

A refrigerator-freezer having a first compartment wherein the first compartment is accessible via a rotatable mounted door with the rotatable mounted door being operable to remain disposed within the housing of the refrigerator-freezer during movement thereof. The refrigerator-freezer further includes a second compartment adjacent to the first compartment wherein the second compartment includes a plurality of sealably mounted storage containers slidably mounted within the second compartment. A third compartment is present and is configured to be extendable outward from the housing of the refrigerator-freezer and subsequently be lifted upward via a lifting mechanism. A controller is included to facilitate operation of the refrigerator-freezer. The controller further includes a voice recorder and a printer. The first compartment has disposed therein a plurality of storage bins that are slidably mounted. A battery power supply is included to provide emergency reserve power in the event the conventional AC power supply is disrupted.

19 Claims, 2 Drawing Sheets

(56) References Cited

U.S. PATENT DOCUMENTS

| | | | | |
|---|---|---|---|---|
| 8,671,712 | B2 * | 3/2014 | Noel | F25D 25/025 312/330.1 |
| 8,827,390 | B2 * | 9/2014 | Wehner | F25D 23/028 312/306 |
| 9,534,825 | B2 * | 1/2017 | Eveland | F25D 11/02 |
| 2014/0000170 | A1 * | 1/2014 | Buck | E05B 1/0069 49/353 |

* cited by examiner

REFRIGERATOR-FREEZER

FIELD OF THE INVENTION

The present invention relates generally to food storage apparatus, more specifically but not by way of limitation, a refrigerator that includes a refrigeration compartment and a freezer compartment wherein the freezer compartment is operable to extend outward and upward from the housing and wherein the refrigerator compartment includes roll style door that remains within the housing of the refrigerator when opened.

BACKGROUND

Refrigerators are well known in the art. Many commercial examples exist in the marketplace ranging from refrigerator-freezer combinations that are typically utilized in a household to walk-in designs that are utilized in restaurants and the like. Cold storage of food is required to maintain freshness and prolong the quality of food during storage thereof. There are numerous different models available to the general consumer with each model having various features addressed at providing convenience.

One problem with conventional household refrigerator-freezer combinations is the door. Current technology for all existing refrigerators have an access door that is a conventional hinge mounted door that is operable to either swing open left or right. This conventional configuration causes problems in small kitchens where there is a lack of space for the conventional style door to swing open. Additionally, most kitchen cabinets adjacent to a refrigerator-freezer are designed to specifically accommodate the conventional swinging door of an existing refrigerator-freezer.

Another issue with existing refrigerator-freezer units is the lack of ergonomic access to certain compartments. Over the last several years, conventional refrigerator-freezer units have begun to include the freezer compartment as a bottom unit. This places the freezer compartment at a very low level and has made access thereto by individuals with ailments such as but not limited too bad backs very difficult.

Accordingly, there is a need for a refrigerator-freezer unit that includes a roll-style door providing improved access to the refrigerator compartment and further includes a freezer compartment that is operable to extend outward and upward from the unit housing so as to provide improved access thereto.

SUMMARY OF THE INVENTION

It is the object of the present invention to provide a refrigerator-freezer unit that includes a refrigerator compartment and a freezer compartment wherein the refrigerator compartment includes a translucent door that is mounted so as to remain within the refrigerator-freezer unit housing when opened.

Another object of the present invention is to provide a refrigerator-freezer unit having a refrigerator compartment and a freezer compartment wherein the freezer compartment is slidably mounted on tracks or similar mechanism that facilitate the ability to extend the freezer compartment outward from the refrigerator-freezer unit housing.

A further object of the present invention is to provide a refrigerator-freezer unit that includes a refrigerator compartment and a freezer compartment wherein the freezer compartment further includes a lift mechanism so as to facilitate the upward movement of the freezer compartment subsequent to extending the freezer compartment outward from the refrigerator-freezer unit housing.

An additional object of the present invention is to provide a refrigerator-freezer unit having a refrigerator compartment and a freezer compartment wherein the refrigerator compartment includes a plurality of storage compartments slidably mounted within the refrigerator compartment.

Still a further object of the present invention is to provide a refrigerator-freezer unit that includes a refrigerator compartment and a freezer compartment wherein the plurality of storage compartments disposed within the refrigerator compartment include angled sidewalls.

An alternative object of the present invention is to provide a refrigerator-freezer unit having a refrigerator compartment and a freezer compartment that includes a plurality of vertically oriented storage compartments mounted to the left of the roll-style door operable to store smaller items.

Yet another object of the present invention is to provide a refrigerator-freezer unit having a refrigerator compartment and a freezer compartment that includes a door opening assembly that includes an electric motor and a pair of support arms that are operably coupled to the refrigerator door.

Another object of the present invention is to provide a refrigerator-freezer unit that includes a refrigerator compartment and a freezer compartment that includes a control panel operable to provide a user interface to control the features of the refrigerator-freezer unit.

An additional object of the present invention is to provide a refrigerator-freezer unit having a refrigerator compartment and a freezer compartment that includes a voice activated list generator that is operable to receive voice data such as a list of items required for purchase at a grocery store and further include the ability to generate a printed copy of the received data.

Yet another object of the present invention is to provide a refrigerator-freezer unit that includes a refrigerator compartment and a freezer compartment that further includes an emergency backup battery power supply.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 2:
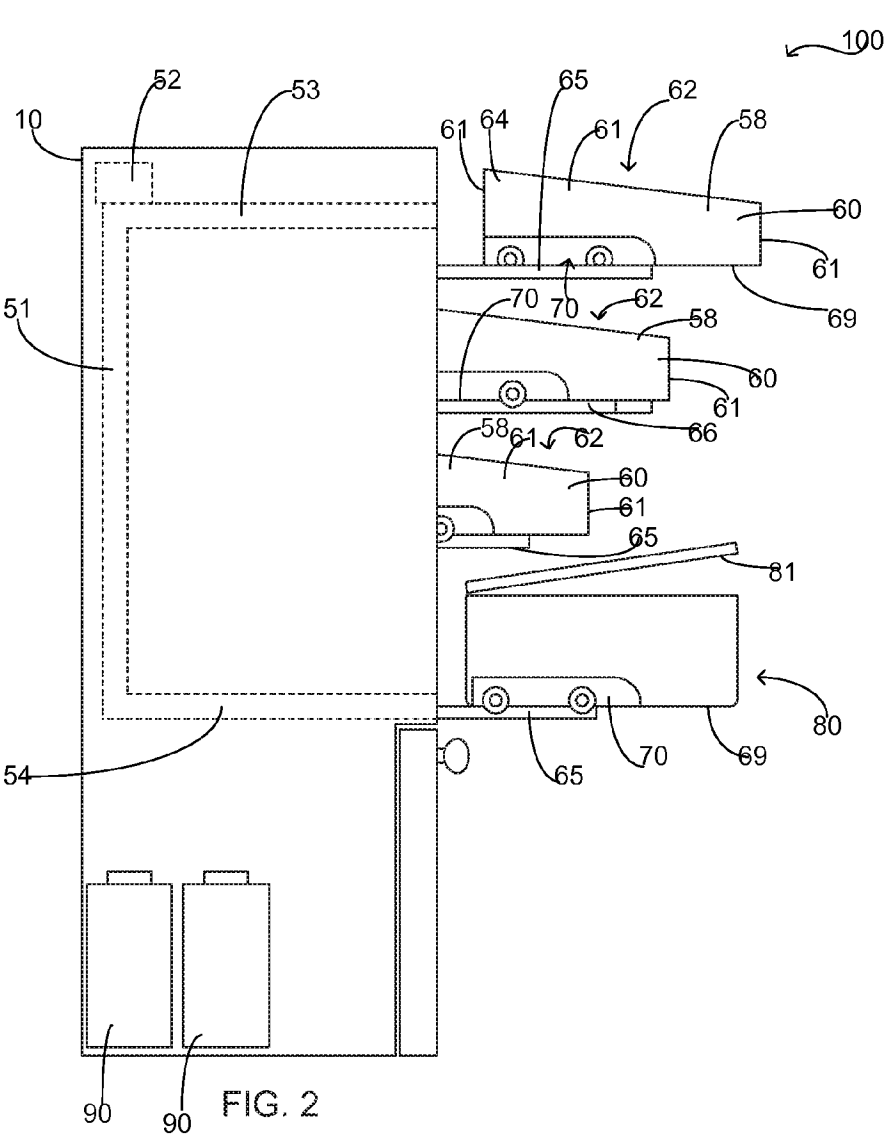
FIG. 2 is a side diagrammatic view of the preferred embodiment of the present invention.

Referring now to the drawings submitted herewith, wherein various elements depicted therein are not necessarily drawn to scale and wherein through the views and figures like elements are referenced with identical reference numerals, there is illustrated a refrigerator-freezer 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 1:
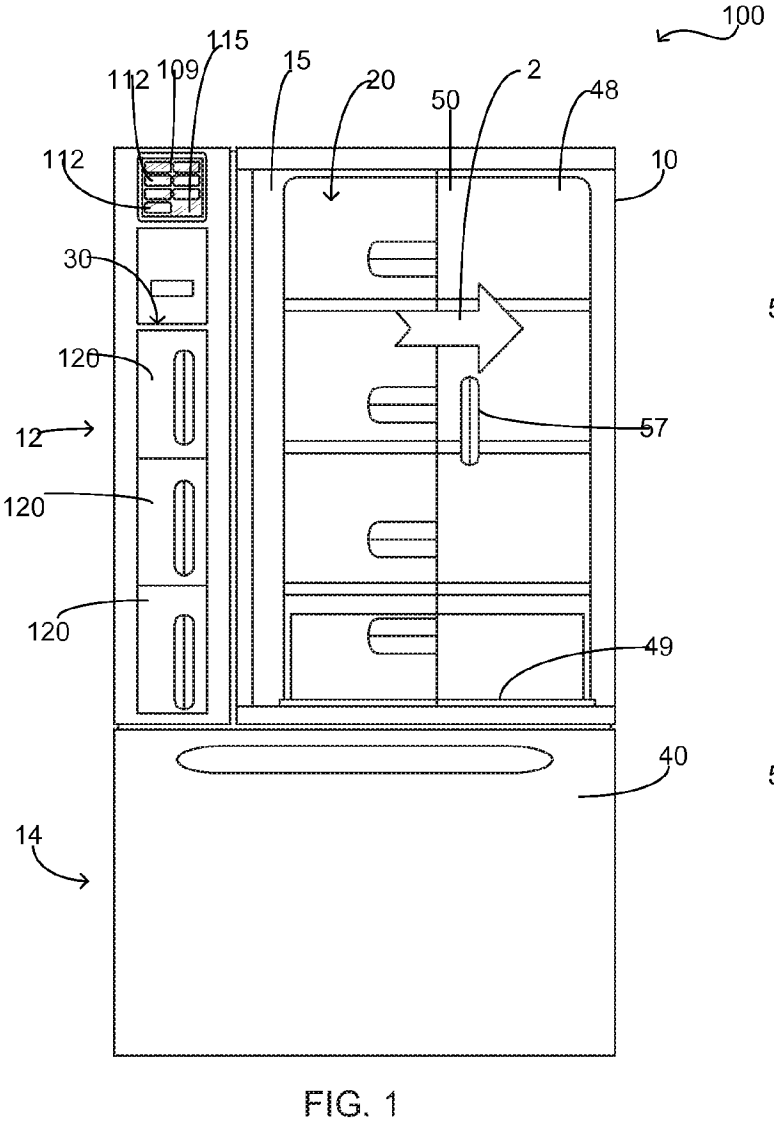
FIG. 1 is a front diagrammatic view of a preferred embodiment of the present invention.

Referring now to FIG. 1 submitted herewith, the refrigerator-freezer 100 further includes a housing 10 that is manufactured from a suitable durable material such as but not limited to metal. The housing 10 further includes an integral layer of insulation (not illustrated herein) so as to assist in maintaining the temperature within the interior volume 15 of the housing 10 at a temperature less than that of its surroundings. The housing 10 is divided into a first compartment 20, a second compartment 30 and a third compartment 40. The first compartment 20 and second compartment 30 are adjacent to each other and located within the upper portion 12 of the housing 10. The third compartment 40 comprises the lower portion 14 of the housing 10. The first compartment 20 is sized such that it is larger than that of the third compartment 30. The first compartment 20 includes a rotatably mounted access door 50. The access door 50 is operable to rotate in the direction as indicated by arrow 2 when being moved to its open position so as to permit access to the interior volume 15 of the first compartment 20. The access door 50 is rotatably mounted utilizing arms 53, 54 that are operably coupled with shaft 51. Shaft 51 is operated by motor 52. The arms 53,54 and shaft 51 are manufactured from a suitable durable material such as but not limited to metal and arms 53,54 are secured to the upper edge 48 and lower edge 49 of the access door 50 respectively utilizing suitable durable means. The motor 52 is a conventional electric motor and is operably coupled to shaft 51 so as to provide rotation thereof. The motor 52 is controlled by controller 110. Controller 110 is a user interface having a conventional touch screen and the necessary electronics to receive, transmit, store and manipulate data. The controller 110 provides an interface for a user to transition the access door 50 intermediate its first position and its second position. During its movement between its first position and its second position the access door 50 is retained within the housing 10 on tracks or other suitable elements not illustrated herein. Access door 50 includes handle 57 that is integrally secured thereto and provides an interface to move access door 50 intermediate its first position and second position if a user decides not to utilize controller 110.

Referring in particular to FIG. 2, slidably mounted within the first compartment 20 are a plurality of storage bins 60. The storage bins 60 includes walls 61 and are operable to receive a plurality of items such as but not limited to perishable grocery items. The storage bins 60 have an opening 62 that provide access to the interior volume thereof. The storage bins 60 are operable coupled to mounts 65 which are slidably mounted to housing 10 utilizing suitable durable techniques. Mounts 65 are manufactured from a suitable durable material such as but not limited to metal. The mounts 65 provide a technique to transition the storage bins 60 intermediate their first position and their second position. In their first position the storage bins 60 are completely disposed within the interior volume 15 of the first compartment 20. In their second position, the storage bins 60 are extended outward from the interior volume 15 as shown in FIG. 2 so as to provide access to the contents stored therein. The storage bins 60 include an angular sidewall 58 that has a height that is lower proximate end 63 than end 64. The angled sidewall 58 provides support for contents that are greater in height to be stored proximate end 64. Storage bins 60 further include wheel assembly 70 that are secured to the bottom 69 thereof utilizing suitable durable techniques. Wheel assembly 70 provides a means to facilitate the enhanced extension of the storage bins 60 outward from the housing 10 so as to provide unrestricted access to the contents disposed therein.

Still referring to FIG. 2, a lower storage bin 80 is operably secured within the first compartment 20. The lower storage bin 80 is similar to storage bins 60 being secured to slidable mounts 65 and having wheel assembly 70. Lower storage bin 80 includes lid 81 that is hingedly secured utilizing suitable durable techniques. Lid 81 provides a technique to provide separate temperature control within the interior volume thereof. While three storage bins 60 and one lower storage bin 80 are illustrated herein, it is contemplated within the scope of the present invention that the refrigerator-freezer 100 could be manufactured with any number of storage bins 60 and lower storage bins 80. Still referring in particular to FIG. 2, the refrigerator-freezer 100 further includes a battery backup system 90. The refrigerator-freezer 100 is operably coupled to a conventional AC power supply in order to operate the compressor (not illustrated herein) so as to maintain a temperature within the housing 10 lower than that of its surroundings. The battery backup 90 functions to provide the necessary power to operate the refrigerator-freezer 100 in the event the conventional power source is disrupted. Those skilled in the art will recognize that the battery backup 90 could be manufactured using various known battery materials such as but not limited to alkaline or lithium ion.

The second compartment 30 located adjacent to the first compartment 20 includes a plurality of receptacles 120. The receptacles 120 are slidably mounted within the housing 10 utilizing suitable durable techniques. Each receptacle is sealably mounted so as to ensure that the interior temperature thereof is operable to maintain a temperature that is lower than that of its surroundings. The receptacles 120 are arranged in a vertical orientation and are operable to store various items such as but not limited to perishable condiments.

Figure 3:
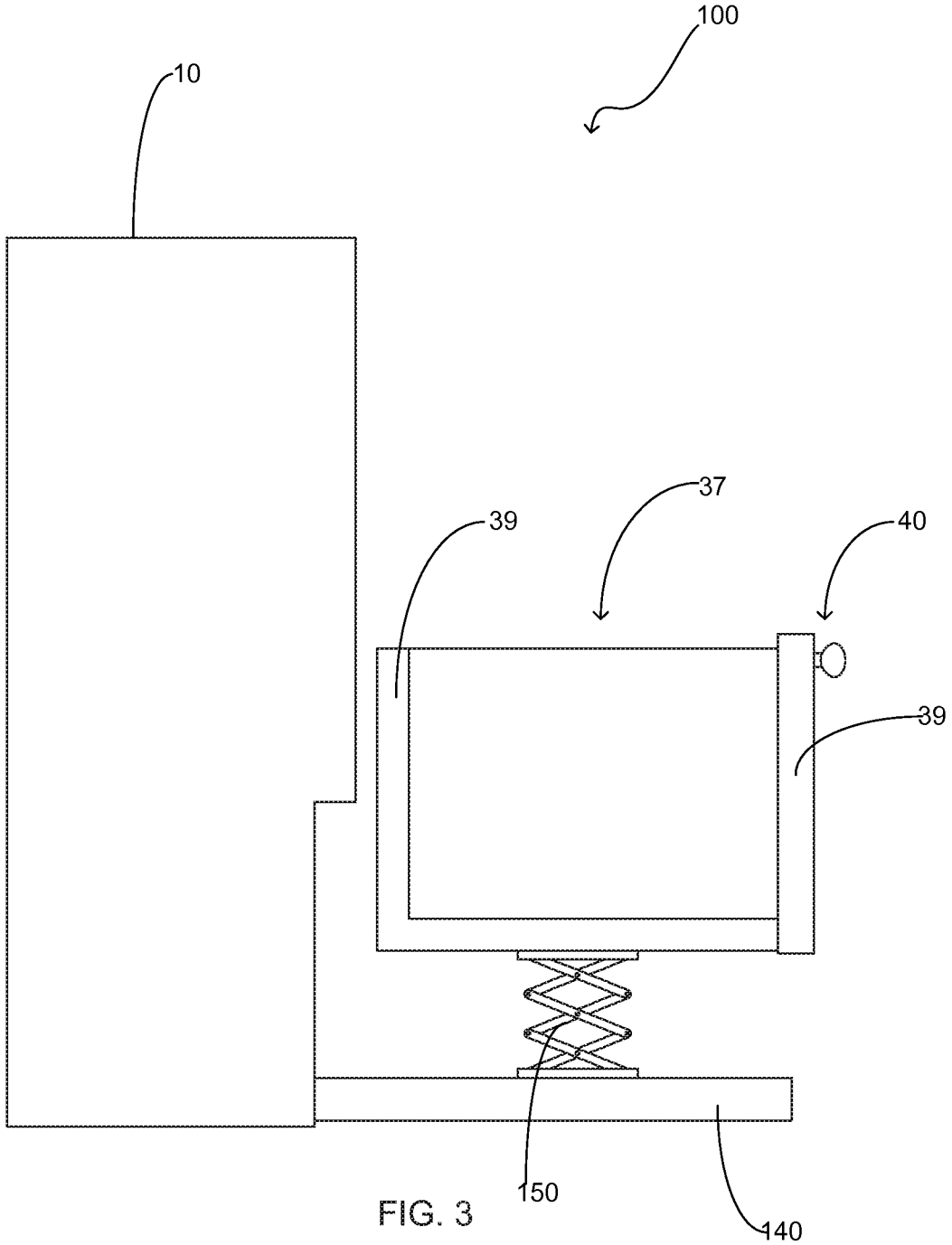
FIG. 3 is a side diagrammatic view of the preferred embodiment of the present invention with the freezer compartment in its second position.

The third compartment 40 is a freezer. The third compartment 40 includes a plurality of walls 39 and bottom 38 forming an interior volume 37 operable to receive and store contents therein. The third compartment 40 is slidably mounted within housing 10 via mount 140 that is operable to transition the third compartment 40 between its first position and its second position. As shown in particular in FIG. 3 herein, the third compartment 40 is extended outward from housing 10 so as to provide access to the interior volume 37 thereof. To provide improved access to the interior volume thereof the third compartment 40 is mounted to lifting mechanism 150. The lifting mechanism 150 is operable to move the third compartment in an upwards-downwards direction. This provides the ability to access the interior volume 37 subsequent the third compartment 40 being transitioned to a position wherein the third compartment 40 has been extended upward from the mount 140 as shown in FIG. 3 submitted herewith. The lifting mechanism 150 and the mount 140 are operably coupled to the controller 110 providing control of the operations thereof. While the lifting mechanism 150 is illustrated herein as being a scissor-jack type of lift, it is contemplated within the scope of the present invention that the lifting mechanism 140 could be constructed from various different conventional lifting devices in order to achieve the desired functionality as described herein.

The controller 110 as previously described herein provides an interface to control the operation of the refrigerator-freezer 100. The controller 110 further includes plurality of control buttons 112 that are conventional graphical button icons on the screen 109 providing a technique of control. The controller 110 further includes the necessary electronics to receive, store and manipulate voice data. By way of example but not limitation, the controller 110 can be utilized to record a voice data citing a list of ingredients that is desired to be purchased. Further the controller 110 includes a printer 115 that is a conventional printer wherein the printer 115 will print the captured voice data so as to provide a printed list of the voice data captured such as an exemplary list of ingredients required for purchase. This skilled in the art will recognize that the controller 110 could be embodied in various different manners in order to accomplish the desired functionality discussed herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A refrigerator-freezer comprising:

a housing, said housing being rectangular in shape, said housing having a plurality of walls, a bottom and a top operable to form an interior volume, said housing be manufactured from a durable material, said housing operable to insulate the interior volume so as to maintain the temperature of the interior volume at a temperature that is lower than that of its surroundings;

a first compartment, said first compartment being defined in the interior volume of the housing having an opening providing access thereto, said first compartment having an interior volume, said first compartment having a plurality of storage bins movably mounted therein, said first compartment having a door operable to cover the opening to the first compartment, said door being rotatably mounted, said door having a first position and a second position;

a shaft and arm assembly, said shaft and arm assembly having an upper arm and a lower arm, said upper arm being mounted within the interior volume of the first compartment proximate the top of said housing, said lower arm being mounted within the interior volume of the first compartment distal to said upper arm, said shaft being mounted within the interior volume of the first compartment distal to said door, said shaft and arm assembly being operably coupled to said door of the first compartment, wherein, in said second position, said door being disposed within said first compartment;

a second compartment, said second compartment being defined in the interior volume of said housing, said second compartment being adjacent to said first compartment, said second compartment having a plurality of storage containers, said plurality of storage containers being slidably mounted within said second compartment;

a third compartment, said third compartment being beneath said first compartment and said second compartment, said third compartment having a plurality of walls and a bottom operable to define an interior volume and an opening, said third compartment being mounted on a slidable mounting plate, said slidable mounting plate operable to extend outward from said housing, said third compartment further including a lifting mechanism, said lifting mechanism being mounted intermediate the bottom of the third compartment and the mounting plate, said lifting mechanism operable to move said third compartment in an upwards and downwards direction; and a controller, said controller being mounted within said housing, said controller having the necessary electronics to store, receive, transmit and manipulate data, said controller operable to provide a user interface to facilitate operation of the refrigerator-freezer.

2. The refrigerator-freezer as recited in claim 1, wherein said controller further includes a voice recorder, said voice recorder operable to receive and store voice data from a user.

3. The refrigerator-freezer as recited in claim 2, and further including a printer, said printer operably coupled to said controller, said printer operable to print voice data stored in said controller.

4. The refrigerator-freezer as recited in claim 3, wherein said plurality of storage bins further include wheel assemblies secured thereto.

5. The refrigerator-freezer as recited in claim 4, and further including a motor, said motor being operably coupled to said shaft and arm assembly, said motor being operably coupled to said controller, said motor providing operation of the door of said first compartment.

6. The refrigerator-freezer as recited in claim 5, and further including a battery power supply, said battery power supply operable to provide backup power to the refrigerator-freezer.

7. A refrigerator-freezer having a freezer compartment that is operable to extend outward therefrom and further be movable to a position that is greater in height comprising:

a housing, said housing being rectangular in shape, said housing having a plurality of walls, a bottom and a top operable to form an interior volume, said housing be manufactured from a durable material, said housing operable to insulate the interior volume so as to maintain the temperature of the interior volume at a temperature that is lower than that of its surroundings;

a first compartment, said first compartment being defined in the interior volume of the housing having an opening providing access thereto, said first compartment having a plurality of storage bins movably mounted therein, said plurality of storage bins having a first end and a second end, said first compartment having a door operable to cover the opening to the first compartment, said door being rotatably mounted, said door having a first position and a second position;

a second compartment, said second compartment being defined in the interior volume of said housing, said second compartment being adjacent to said first compartment, said second compartment having a plurality of storage containers, said plurality of storage containers being slidably mounted within said second compartment;

a third compartment, said third compartment being beneath said first compartment and said second compartment, said third compartment having a plurality of walls and a bottom operable to define an interior volume and an opening, said third compartment being mounted on a slidable mounting plate, said slidable mounting plate being horizontally disposed within the housing proximate said bottom thereof, said slidable mounting plate operable to extend outward from said housing;

a shaft and arm assembly, said shaft and arm assembly having an upper arm and a lower arm, said upper arm being mounted within the interior volume of the first compartment proximate the top of said housing, said lower arm being mounted within the interior volume of the first compartment distal to said upper arm, said shaft being mounted within the interior volume of the first compartment distal to said door, said shaft and arm assembly being operably coupled to the door of the first compartment providing operation thereof, wherein, in said second position, said door being disposed within said first compartment;

a lifting mechanism, said lifting mechanism being a scissor jack, said lifting mechanism being mounted intermediate the bottom of the third compartment and the mounting plate, said lifting mechanism operable to move said third compartment in an upwards and downwards direction;

a controller, said controller being mounted within said housing, said controller having the necessary electronics to store, receive, transmit and manipulate data, said controller operable to provide a user interface to facilitate operation of the refrigerator-freezer.

8. The refrigerator-freezer as recited in claim 7, and further including a motor, said motor being operably coupled to said shaft of said shaft and arm assembly, said motor being operable to rotate said door intermediate its first position and second position.

9. The refrigerator-freezer as recited in claim 8, wherein said plurality of storage bins further include sidewalls, said sidewalls being greater in height proximate the second end of said plurality of storage bins.

10. The refrigerator-freezer as recited in claim 9, wherein said controller further includes a voice recorder, said voice recorder operable to receive and store voice data from a user.

11. The refrigerator-freezer as recited in claim 10, and further including a printer, said printer operably coupled to said controller, said printer operable to print voice data stored in said controller.

12. The refrigerator-freezer as recited in claim 11, wherein the door of the first compartment is transparent.

13. The refrigerator-freezer as recited in claim 12, and further including a battery power supply, said battery power supply operable to provide backup power to the refrigerator-freezer.

14. A refrigerator-freezer having an access door that is rotatably mounted so as to maintain position within the housing of the refrigerator-freezer comprising:

a housing, said housing being rectangular in shape, said housing having a plurality of walls, a bottom and a top operable to form an interior volume, said housing be manufactured from a durable material, said housing operable to insulate the interior volume so as to maintain the temperature of the interior volume at a temperature that is lower than that of its surroundings;

a first compartment, said first compartment being defined in the interior volume of the housing having an opening providing access thereto, said first compartment having a plurality of storage bins movably mounted therein, said plurality of storage bins having a first end and a second end, said first compartment having a door operable to cover the opening to the first compartment, said door being rotatably mounted, said door having a first position and a second position;

a second compartment, said second compartment being defined in the interior volume of said housing, said second compartment being adjacent to said first compartment, said second compartment having a plurality of storage containers, said plurality of storage containers being slidably mounted within said second compartment;

a third compartment, said third compartment being beneath said first compartment and said second compartment, said third compartment having a plurality of walls and a bottom operable to define an interior volume and an opening, said third compartment being superposed a slidable mounting plate, said slidable mounting plate being horizontally mounted within the interior volume of the housing proximate said bottom, said slidable mounting plate operable to extend outward from said housing;

a shaft and arm assembly, said shaft and arm assembly having an upper arm and a lower arm, said upper arm being mounted within the interior volume of the first compartment proximate the top of said housing, said lower arm being mounted within the interior volume of the first compartment distal to said upper arm, said shaft being mounted within the interior volume of the first compartment distal to said door, said shaft and arm assembly being operably coupled to the door of said first compartment, said door having a first position and a second position, said door in said second position being rotated towards the rear wall of said housing so as to provide access to the interior volume of said first compartment, wherein, in said second position, said door being disposed within said first compartment;

a lifting mechanism, said lifting mechanism being mounted intermediate the bottom of the third compartment and the mounting plate, said lifting mechanism being configured as a scissor jack, said lifting mechanism operable to move said third compartment in an upwards and downwards direction;

a motor, said motor being operably coupled to said shaft of said shaft and arm assembly, said motor being operable to rotate said door intermediate its first position and second position; and a controller, said controller being mounted within said housing, said controller having the necessary electronics to store, receive, transmit and manipulate data, said controller operable to provide a user interface to facilitate operation of the refrigerator-freezer.

15. The refrigerator-freezer as recited in claim 14, wherein said controller further includes a voice recorder, said voice recorder operable to receive and store voice data from a user.

16. The refrigerator-freezer as recited in claim 15, and further including a printer, said printer operably coupled to said controller, said printer operable to print voice data stored in said controller.

17. The refrigerator-freezer as recited in claim 16, wherein said plurality of storage bins further include sidewalls, said sidewalls being greater in height proximate the second end of said plurality of storage bins.

18. The refrigerator-freezer as recited in claim 17, wherein said plurality of storage bins further include wheel assemblies secured thereto.

19. The refrigerator-freezer as recited in claim 18, and further including a battery power supply, said battery power supply operable to provide backup power to the refrigerator-freezer.

* * * * *